US005368616A

United States Patent [19]

Natschke et al.

[11] Patent Number: 5,368,616

[45] Date of Patent: Nov. 29, 1994

[54] METHOD FOR DECREASING AIR POLLUTION FROM BURNING A COMBUSTIBLE BRIQUETTE

[75] Inventors: David F. Natschke, Apex; Christopher C. Lutes; Jeffrey V. Ryan, both of Chapel Hill, all of N.C.

[73] Assignee: Acurex Environmental Corporation, Durham, N.C.

[21] Appl. No.: 76,352

[22] Filed: Jun. 11, 1993

[51] Int. Cl.[5] ..... C01L 5/02

[52] U.S. Cl. ..... 44/559; 44/551

[58] Field of Search ..... 44/559

[56] References Cited

U.S. PATENT DOCUMENTS

| | | | |
|---|---|---|---|
| 13,637 | 3/1873 | Hayes | 44/559 |
| 1,875,287 | 8/1932 | Weber | 44/559 |
| 2,110,370 | 3/1938 | Lum | 44/1 |
| 3,332,755 | 7/1967 | Kukin | 44/4 |
| 3,927,992 | 12/1975 | Kerley | 44/4 |
| 3,948,617 | 4/1976 | Withorn | 44/4 |
| 3,970,434 | 7/1976 | Gasior et al. | 44/1 F |
| 4,092,125 | 5/1978 | Stambaugh et al. | 44/1 R |
| 4,111,755 | 9/1978 | Ban et al. | 201/6 |
| 4,152,120 | 5/1979 | Zavitsonos et al. | 44/1 R |
| 4,210,423 | 7/1980 | Yan | 44/1 C |
| 4,226,601 | 10/1980 | Smith | 44/10 D |
| 4,259,085 | 3/1981 | Ban et al. | 44/26 |
| 4,262,610 | 4/1981 | Hein et al. | 110/342 |
| 4,274,835 | 6/1981 | Jordan | 44/1 SR |
| 4,280,817 | 7/1981 | Chauhan et al. | 44/1 R |
| 4,288,293 | 9/1981 | Saller | 201/6 |
| 4,319,885 | 3/1982 | Brown | 44/15 R |
| 4,381,718 | 5/1983 | Carver et al. | 110/347 |
| 4,408,723 | 10/1983 | Adrian et al. | 241/19 |
| 4,432,771 | 2/1984 | Sawyer, Jr. | 44/559 |
| 4,492,771 | 1/1985 | Hasegawa et al. | 502/420 |
| 4,515,601 | 5/1985 | Charters | 44/19 |
| 4,519,807 | 5/1985 | Nishino et al. | 44/15 R |
| 4,519,995 | 5/1985 | Schröfelbauer et al. | 423/244 |
| 4,530,701 | 7/1985 | Koskan et al. | 44/51 |
| 4,582,005 | 4/1986 | Brown | 110/347 |
| 4,588,568 | 5/1986 | Pollmann et al. | 423/244 |
| 4,618,347 | 10/1986 | Watt et al. | 44/16 F |
| 4,618,348 | 10/1986 | Hayes et al. | 44/51 |
| 4,635,572 | 1/1987 | Nickel | 110/343 |
| 4,642,225 | 2/1987 | Leikert | 423/244 |
| 4,661,119 | 4/1987 | Andersson et al. | 44/559 |
| 4,702,899 | 10/1987 | Barczak et al. | 423/244 |
| 4,787,914 | 11/1988 | Crace | 44/559 |
| 4,807,542 | 2/1989 | Dykema | 110/343 |
| 4,824,438 | 4/1989 | McCrainor et al. | 44/16 F |
| 4,824,441 | 4/1989 | Kindig | 44/604 |
| 4,861,723 | 8/1989 | Madgavkar | 435/262 |
| 4,886,519 | 12/1989 | Hayes et al. | 44/51 |
| 4,936,047 | 6/1990 | Feldmann et al. | 48/197 R |
| 4,964,881 | 10/1990 | Sharma et al. | 44/620 |
| 4,968,324 | 11/1990 | Franke et al. | 44/604 |
| 5,064,801 | 11/1991 | Jüntgen et al. | 502/180 |

OTHER PUBLICATIONS

Publication entitled, "Full-scale Laboratory Simulation Facility to Test Particulate and Organic Emissions from a Third World Residential Combustion Process III [sic, and] Evaluation of a Potential Technique for the Control of Emissions from the Indoor, Open Hearth Combustion of Coal," by Lutes et al., pp. 1–23, presented at the 85th Annual Meeting & Exhibition of the Air & Waste Management Association, Kansas City, MO, Jun. 21–26, 1992.

*Primary Examiner*—Ellen M. McAvoy

*Attorney, Agent, or Firm*—Richard E. Jenkins

[57] ABSTRACT

The present invention provides a method of decreasing air pollution from burning a combustible carbonaceous material, wherein the combustible carbonaceous material comprises an admixture of a non-combustible binder material, such as clay, and a combustible carbonaceous substance in the form of chunks of briquettes, in a natural draft furnace. The method comprises burning the chunks of briquettes, wherein said briquettes have been prepared by mixing about 60 to about 90 parts combustible carbonaceous particles, such as coal, with 40 to about 10 parts non-combustible binder material, such as clay, in a sufficient amount of water to obtain a moldable mixture, molding the mixture into a briquette form, allowing the briquette form to dry, preferably at a temperature above about room temperature from about 2 to about 6 days to form dried briquettes, preferably about 2 to about 25 cm on a side. The briquettes are burned in a natural draft furnace, whereby the emissions are decreased about 60 to about 90% as compared to the emissions from the burning of coal free of any treatment with non-combustible binder material.

13 Claims, No Drawings

METHOD FOR DECREASING AIR POLLUTION FROM BURNING A COMBUSTIBLE BRIQUETTE

This invention was made with government support under Contract No. 68-02-4701 awarded by the U.S. Environmental Protection Agency. The U.S. Government has certain rights in the invention.

TECHNICAL FIELD

This invention relates to a method for decreasing air pollution from the burning of combustible carbonaceous substances such as coal. More particularly, the invention relates to the burning of a briquette, wherein the briquette comprises a non-combustible binder material, such as clay or concrete, and a combustible carbonaceous substance, in a natural draft furnace, whereby the emissions that cause air pollution are decreased. As the air pollution is decreased, so should there be a concomitant decrease in the incidence of lung cancer associated with the emissions causing air pollution as a result of the burning of combustible carbonaceous substances.

BACKGROUND OF THE INVENTION

As is well known, the present supply of oil is being rapidly depleted. Thus, its use as a source of energy, i.e. a heating fuel in a furnace, is becoming increasingly expensive while the supply is becoming increasingly uncertain. Accordingly, attempts have been made to substitute other types of fuels for oil, such as coal, charcoal, and the like.

However, coal and charcoal, when burned in a natural draft furnace (such as a small unit in an apartment or a boiler for an apartment building) create a great deal of particulate matter, i.e., volatiles, semi-volatiles, gravimetric materials, and the like, which creates air pollution. Accordingly, such use of coal and charcoal has been disparaged. Instead generally the focus with coal and charcoal has been in heavy industry and the power industry.

In heavy industry, the coal was transformed into coke. The coke, and also charcoal, was for use as a reducing agent for iron oxide ores in the manufacture of steel. In the power industry, the coal was burned in some electricity generation plants to generate the electricity. On the other hand, generally the focus with briquettes, compositions of a mineral acting as a binder (such as limestone, i.e., calcium carbonate, or clay, i.e. aluminum silicate, also known as zeolite) admixed with coal, charcoal, and combinations thereof, has been for food-cooking grills or stoves. For instance, there are the American outdoor grill used in the backyard or patio, and the Asian charcoal cook stove, such as the indoor portable hibachi used by the Japanese or the indoor in-ground pit with separator directing air flow to the bottom thereof used by the rural Chinese.

With respect to briquettes for instance, U.S. Pat. No. 4,787,914 to Crace (issued Nov. 29, 1988) involves a briquette wherein clay in a desired predetermined portion is added to charcoal, coal, or a mixture thereof, to achieve a desired flavor enhancement for a food-cooking briquette.

Also of interest is U.S. Pat. No. 2,110,370 to Lum (issued Mar. 8, 1938). This patent involves a composition of bituminous coal and clay that is heated to 350° C., preferably in the absence of oxygen, to produce a product with a decreased clinkering tendency as compared to bituminous coal absent the clay.

Additionally relating to briquettes is U.S. Pat. No. 4,661,119 to Andersson et al. (issued Apr. 28, 1987). This patent involves briquettes suitable for use as an auxiliary fuel for the melting of minerals in the manufacture of mineral wool. The briquettes comprise 30–75% by weight particles of coke fines or coal fines, at least 7% by weight hydraulic cement binder, and at least 15% by weight filler that is an oxidic mineral component chosen from sand (silicon dioxide) or limestone powder (calcium carbonate powder).

Also, it is noted that U.S. Pat. No. 1,875,287 to Weber (issued Aug. 30, 1932) involves a process for preparing semi-coke briquettes from bituminous coal. The process involves preparing a binding agent containing sulphite spent liquor with clay in a colloidal suspension, mixing the binding agent with fine bituminous coal, and forming the mixture into briquettes. The briquettes are then heated to drive off moisture and then subjected to a low temperature carbonization.

Another related patent is U.S. Pat. No. 4,432,771 to Sawyer (issued Feb. 21, 1984). This patent involves an aqueous fuel slurry of 65–70% coal powder, 0.5–5% by weight wetting agent, 0.15–0.8% by weight clay stabilizing composition, and the remainder water. The clay stabilizing composition, when added to the aqueous fuel slurry, provides a stabilizing gel structure for the slurry.

Lastly of background interest is U.S. Pat. No. 136,375 to Hayes (issued Mar. 4, 1873). This patent involves a process of combining calcareous clay and coal waste with boiling water, mixing the resultant under high heat to obtain 8–12% calcareous clay, and then mixing the resultant with asphalt.

OBJECTS AND SUMMARY OF THE INVENTION

The present invention provides a method of decreasing air pollution that occurs from burning a combustible carbonaceous material in a natural draft furnace. The method comprises decreasing emissions that cause air pollution by burning a combustible carbonaceous material, wherein the combustible carbonaceous material comprises an admixture of a carbonaceous substance and a non-combustible binder material in the form of briquettes.

The briquettes have been prepared by treating a carbonaceous substance, preferably coal, with a non-combustible binder material, preferably clay. The treating involves mixing from about 60 to about 90 parts of particles of the carbonaceous substance with about 40 to about 10 parts of the non-combustible binder material, based on a total amount of 100 parts by volume of carbonaceous substance and non-combustible binder material, in a sufficient amount of water to obtain a moldable mixture. Then, the aqueous mixture is molded into a brick form, and the brick form is allowed to dry. The brick form may be small enough to use as is as a briquette, or alternatively, if the brick form is large, it could be formed into smaller briquettes, such as by breaking or cutting or pressing. The drying should take place at a temperature above about room temperature from about 2 to about 6 days to form dried briquettes.

Next, the dried briquettes are burned in a natural draft furnace. As a result of the inventive method, the emissions are decreased from about 50 to about 90% as compared to the emissions from burning comparably sized carbonaceous substance free of any treatment with non-combustible binder material.

Therefore, it is the object of the present invention to provide a method for the burning of a carbonaceous substance, such as coal, in a natural draft furnace that decreases the air pollution associated with the burning of the carbonaceous substance, such as coal.

It is another object of the present invention to provide a method for the burning of a carbonaceous substance, such as coal, in a natural draft furnace that will reduce emissions therefrom which method involves treating the carbonaceous with an inexpensive, readily available binder material, such as clay.

Accordingly, it is an advantage of the present invention that since the emissions that cause air pollution from the burning of a carbonaceous substance, such as coal are decreased, the incidence of lung cancer associated with these emissions from the burning of a carbonaceous substance, such as coal, should also be decreased.

Some of the objects, advantages, and the like of the present invention having been stated above, further objects will become evident as the description proceeds, when taken in connection with the Laboratory Example as best described below.

DETAILED DESCRIPTION OF THE INVENTION

First, it is noted that the following abbreviations are used herein.

| | |
|---|---|
| Total solid particulate = | TSP |
| Volatile organic compound = | VOC |
| Total hydrocarbons = | THC |
| Benzo(a)pyrene = | BAP |
| Products of incomplete combustion = | PIC |
| Total chromatographable organic = | TCO |
| Polycyclic aromatic hydrocarbon = | PAH |
| Mass spectroscopy = | MS |
| Flame ionization detection = | FID |
| Gravimetrically = | GRAV |
| Gas chromatography = | GC |
| Total chromatographable organics = | TCO |
| Environmental Protection Agency = | EPA |
| Air & Energy Engineering Research = Laboratory of EPA | AEERL |

Briquettes of combustible carbonaceous material are prepared from a non-combustible binder material and particles or fines of a carbonaceous substance. Various types non-combustible binder materials may be employed in accordance with the invention, including, but not limited to, clay, cementicious materials (such as concrete), and a combination thereof. Suitable clays include, but are not limited to, montmorillonite, bentonite, kaolinite, ball clay, and combinations thereof. The carbonaceous substance preferably is coal. As examples of carbonaceous substances, it is intended to include, but not be limited to, woody materials (i.e., including but not limiting to charcoal, sawdust, wood chips, and the like), coke, lignite coal (also known as smoky coal), anthracite coal, bituminous coal, and combinations thereof.

The non-combustible binder material and particles of carbonaceous substance are slurried with water. Based on 100 parts by volume of non-combustible binder material and carbonaceous substance, the amount of non-combustible binder material should be from about 10 to about 40 parts by volume and the amount of carbonaceous substance should be from about 60 to about 90 parts by volume, in the water. More preferably, the amount of non-combustible binder material should be from about 15 to about 30 parts by volume and the amount of carbonaceous substance should be from about 70 to about 85 parts by volume. Most preferably, there are present about 15 to 20 parts by volume non-combustible binder material to about 75 to 80 parts by volume carbonaceous substance for a preferred ratio of binder material:carbonaceous substance that ranges from about 1:3 to 1:4. Since the water is eventually evaporated from the slurry, the ratio in the resultant molded briquettes is approximately the same.

The non-combustible binder material and combustible carbonaceous particles are thoroughly mixed in the slurry of water so that the mixture is essentially homogeneous. A sufficient amount of water is employed in order to obtain a thick, plastic-like mixture that can be easily formed or molded into bricks or briquettes. The amount of water can be readily determined by the person of ordinary skill in the art without undue experimentation.

After the resultant mixture is molded into bricks, the bricks are allowed to dry. The drying preferably is from about 2 to about 6 days, more preferably from about 3 to about 5 days, most preferably about 4 days. The drying should be done above about room temperature, more preferably above about 80° F., and can be readily accomplished by setting the molded briquettes outdoors for air drying.

After the molded bricks are dried, they may be suitably small enough so that they may be used as is as a briquette. In other words, at the molding step described in the above paragraph, briquettes of appropriate size could be molded or pressed into a desired shape, and then subjected to the drying. Alternatively, larger bricks could be formed into smaller pieces that are of a suitable briquette size. For instance, a person could form the bricks into briquettes by breaking the bricks in various ways, such as by hand or with a hammer, and the like, thereby forming the briquettes. In a factory, the bricks could be formed into briquettes by cutting in various ways, such as with a cutting machine and the like, thereby forming the briquettes. Thus, the forming briquettes may be by breaking, cutting, pressing or a combination thereof.

The briquettes could be of any size, but preferably, the briquettes are of approximately the typical size of pieces or coal employed in coal-burning furnaces. A conveniently sized briquette is approximately 2 cm to approximately 25 cm on a side. By "side", it is intended to mean also this size of approximately 2 cm to approximately 25 cm across, reasonably depending on the shape of the brick or briquette. Also, bricks briquettes could be of any shape, such as generally round, generally oblong, generally rectangular, generally pillow shaped, generally of an irregular lump shape, and it is not intended to be limited thereby.

The bricks or briquettes are then burned in a natural draft furnace. By natural draft furnace, it is intended to mean a furnace that burns coal in a temperature range lower than that of an industrial furnace for heavy industry, which furnace for heavy industry burns coal at a higher temperature and has a forced draft and a stack that collects particulates. A typical temperature range for a natural draft furnace is from about 700° F. (about 371° C.) to about 1400° F. (about 760° C.), more preferably about 800° F. (about 426° C.) to about 1300° F.

(about 704° C.). Because of the forced draft, stack, and higher temperature for burning coal, the furnace for heavy industry can readily decrease hydrocarbon particulates, but a natural draft furnace cannot. A natural draft furnace includes, but is not limited to, a residential furnace (such as that used in an apartment or house), a wood stove (such as that used in an apartment or house), or a light industrial furnace (such as a boiler for an apartment building).

When the bricks or briquettes of carbonaceous substance treated with non-combustible binder material are burned in a natural draft furnace, surprisingly the emissions are drastically decreased as compared to the emissions from burning a comparably sized carbonaceous substance, such as coal, that has not been treated with a non-combustible binder material, such as clay. The decrease that can be achieved with the present invention is about 50% to about 90%, more preferably about 60% to about 80%, most preferably about 65% to about 75%. As discussed in further detail in the Laboratory Example below, for the experiment performed, total chromatographable organics emissions were decreased approximately 90%. Also, benzo(a)pyrene emissions were decreased approximately 65%, and gravimetric non-volatile organics emissions were decreased approximately 70%.

LABORATORY EXAMPLE

The coal used was lignite coal (also known as smoky coal), obtained from the Hong Chong mine, the major source of smoky coal used in Xuan Wei County of the Peoples Republic of China. The clay was selected for its ready availability and was collected in Chapel Hill, N.C. Briquettes of clay and coal were prepared in a manner similar to the way the Chinese people prepare coal briquettes for use on their indoor in-ground pit with separator directing air flow to the bottom thereof.

The Hong Chong coal was ground to two consistencies, a fine gravel and a powder. Clay (20%), powdered coal (40%), gravel-sized coal (40%), on a dry weight basis, in approximately 5 gallons (19 liters) of tap water were mixed for 75 minutes in a cement mixer (Mueller Mixer Company, Metuchen, N.J.). It is noted that due to similar densities of clay and coal, mixing them on a weight basis is substantially the same as mixing them on a volume basis. The resultant plastic-like mixture was then molded or formed into 28 briquettes, each of approximately 20×20×4 cm in size. The molded briquettes were then dried for 4 days exposed to the open air and sunlight. As this was done during the summertime, during the daytime the temperature was approximately 90° F. and the relative humidity was approximately 90%. Next, the dried briquettes were stored at ambient room temperature and humidity until used; the briquettes had a water content of 2.2% by weight when used. Immediately prior to the combustion test, the briquettes were broken into chunks similar in size to the coal chunks used. Both the clay/coal briquettes and the coal were used in chunks of approximately 5 to 10 cm on a side.

The combustion experiments were conducted at the EPA Environmental Research Center in Research Triangle Park, N.C. A 2.4×2.4×2.4 meter metal outbuilding (burn hut) was used to conduct the combustion experiments. The burn hut had a dilution air system that was capable of delivering either 41.6 or 14.4 $m^3$/minute of ambient air (flows measured with an Airdata Flow Meter, Shortridge Instruments Inc., Scottsdale, Ariz.). The dilution air system maintained a slight positive pressure on the burn hut to minimize air infiltration. Combustion of coal and combustion of clay/coal took place in a brick and stainless steel open pit that was 24×28×20 cm in size and located inside the burn hut. The pit bottom had a grate providing a 4 cm deep channel for air circulation. A 25×10 cm hood located 110 cm above one corner of the pit captured the emissions which were carried in a 20.3 cm outside diameter stainless steel insulated sample transport duct from the burn hut into an adjacent sample shed, where the emissions were sampled for testing.

The sampling train was a 0.95 cm internal diameter stainless steel tube leading to a holder for a 142 mm diameter Teflon ® (registered trademark of DuPont for polytetrafluoroethylene) coated glass-fiber filter (Pallflex Company, Putnam, Conn. T60A20). The tube and filter were followed by a drying agent cartridge, a vacuum pump (Gast Company, Benton Harbor, Mich.) and a sampling control panel (Acufex Aerotherm Corp., Mountain View, Calif.). The opening of the sampling tube within the sample transport duct pointed in the downstream direction in order to favor the collection of smaller particulates. The sampling train was checked for leaks from the duct through a dry gas meter before and after the collection of each filter sample. The average sampling rate was 0.07892±0.01175 $m^3$/minute during the coal experiments and 0.08523±0.00201 $m^3$/minute during the clay/coal experiments.

A gas stream for the monitoring of combustion gases (CO, $CO_2$, $O_2$, NO, and $N_2O$) and total hydrocarbons was separately sampled from the sample transport duct. Particulate material was removed from this gas stream by a heated spun glass filter, and the gas stream was transported into the EPA Hazardous Air Pollutants Mobile Laboratory through a Teflon-lined 7.6 m heated sample line (Heater Specialties Company, Furon County, Cape Coral, Fla.). A portion of this gas stream was analyzed continually for total hydrocarbons (THCs), which was calibrated as methane (Scott Model 415 FID Analyzer). The remainder of the gas stream passed through a Hankison (Canonsburg, Pa.) refrigeration condenser. A portion of this gas stream was analyzed continually for NO (Thermoelectron Model 10 Chemiluminescent Instrument) and $N_2O$ by automatic sampling gas chromatography with electron capture detection (GC/ECD) (Hewlett-Packard Model 5890 with Model 3393 integrator) method involving precolumn backflush for the elimination of interferences. A $N_2O$ sample was analyzed every 8 minutes. The remainder of the gas stream passed through a silica gel drying agent and was analyzed continually for CO (Beckman, Model 868, nondispersive infrared analyzer), $CO_2$ (Beckman, Model 868), and $O_2$ (MSA Model 105, paramagnetic oxygen analyzer).

The combustion gas analyzers with the exception of $N_2O$ analyzer were calibrated at the beginning of each experimental day with 2 or 3 certified span gases and zero grade nitrogen. The analyzers were considered to be linear and adequately calibrated if the measured values of the midpoint calibration gases differed from the certified value by less than 2% of the full scale operating range. The analyzers were considered to have maintained calibration throughout the experiment if a post-experimental calibration check was within 15% of the certified value. The $N_2O$ instrument was calibrated according to a logarithmic fit prior to the performance of these tests with a series of 10 calibration gases and checked at the beginning and end of each experimental day by the analysis of at least 2 calibration gases from the set including 0.970, 0.514, and 0.108 ppmv. The instrument was considered to be maintaining adequate calibration if the measured concentration was within the following tolerances: 0.970 ppm±15%, 0.514 ppm±15%, and/or 0.108 ppm±35%, respectively.

Data for all combustion gases except $N_2O$ were recorded at 30-second intervals. Data were also collected at 30-second intervals from 8 thermocouples (Omega Company, Stamford, Conn., Type K, Chromel-Alumel, located in the air inlet ducts, sample shed, fire pit, and sample duct), from a balance on which the fire pit rested (Electroscale Corp., Santa Rosa, Calif., platform with a Pennsylvania Model 5600 control unit), and from a relative humidity probe in the sample duct (Hy-Cal Engineering Company, El Monte, Calif., Model CT-829-A-X20). The relative humidity of the in-flowing air was assumed to be equal to that measured hourly by the National Weather Service located at the nearby Raleigh-Durham International Airport. In calculations based on the weight loss, the assumption was made that all weight loss in the clay/coal combustion experiments was due to the coal's being consumed and not to clay emissions. Data on combustion gases were averaged for the period during which each filter sample was collected, and these mean values were averaged to determine the mean values for each type of combustion. Calculated emissions of combustion gases were corrected for background concentrations by subtracting the average value from the hut blank experiment.

Samples were taken and analyzed to generate data during a series of 6 experimental days. Of these days, 3 days were days where coal only was combusted, and 2 days were days where clay/coal briquettes only were combusted. Also, 1 day was designated as a hut blank, where no coal combustion or clay/coal briquette combustion took place, but rather propane lighting torches were used. The data set also included 1 field and 1 laboratory blank filter sample.

Each experimental day followed the same sequence of events with some minor deviations. First, 6.8 to 11.3 kg of fuel were loaded into the fire pit. Then combustion gas analyzers were calibrated and approximately 15 minutes of background data were collected. Next, 2 or 3 propane torches (Cotter & Co., Chicago, Ill.) were used to ignite the coal for a period of approximately 1 hour (ignition continued until the experimenter was confident that self-sustaining coal combustion had begun). Propane ignition was used instead of the wood ignition process that is used in China (for the cook-stove coal briquettes from Xuan Wei County, discussed above) to obviate any organic emissions from wood combustion which could interfere with the results. Approximately 3 minutes were allowed for propane combustion products to dissipate and then filter sampling was begun. The fuel was stirred at 1 hour, 3 hours, and 5 hours after torch ignition stopped. Additional fuel was added at 2 hours and at 4 hours after torch ignition stopped. Particulate sampling was halted briefly between 2 hours and 3 hours after torch ignition stopped to change to a second filter. Thus, sampling took place during several phases of combustion to simulate total household exposure with a natural draft furnace.

The observed average rates of mass lost during combustion were 0.013±0.004 kg/minute in the coal experiments and 0.017±0.007 kg/minute in the clay/coal experiments. Rates of mass lost in this range were sought in order to produce measurable mass losses while still allowing a multi-hour experiment in order to approach the time scale over which combustion occurs in the field.

Filters were desiccated and weighed on an analytical balance (Mettler AE 240) before and after collection and stored cold in a 1° C. refrigerator after use until extraction. The filters were soxhlet extracted with 400 ml of methylene chloride for 16 hours. The extracts were then concentrated, filtered through a 0.45 micrometer filter, and brought to 25 ml prior to analysis.

The extracts were analyzed in duplicate for total chromatographable organics (TCOs), a measurement which is intended to quantify semi-volatile organic compounds with boiling points between 100° and 300° C., by gas chromatography with flame ionization detection (GC/FID) (Hewlett-Packard 5880A GC and Hewlett-Packard 7672A autosampler). A 30-meter long, 0.32 mm diameter, 0.25 micrometer film DB-5 column (J&W Scientific Company, Folsom, Calif.) was used with a temperature program that began at 40° C. for 3 minutes. The temperature was then ramped at 14° C./minute up to 170° C., then at 4° C./minute up to 255° C., then at 2° C./minute up to 270° C., and then at 16° C./minute up to 300° C. Finally, the temperature was held at 300° C. for 2 minutes. Calibration was performed with a mixture containing $C_7$, $C_{10}$, $C_{12}$, $C_{14}$, and $C_{17}$ n-alkanes. The $C_7$ and $C_{17}$ alkanes were used to define the retention times corresponding to the boiling point range of interest, and the sum of the other alkane responses was used to develop the calibration curve. A quality control standard was injected at the beginning and the end of each set of analyses (consisting of no more than 10 samples). Instrument performance was considered satisfactory if the analytical TCO value of the quality control sample differed by less than 15% from the known TCO value. The alkane response factors and the GC/FID chromatograms were also used to quantify benzo(a)pyrene (BAP). BAP was identified by comparison with the retention times of a known standard and quantified using the calibration curve developed for the TCO analysis. Samples were re-analyzed if the TCO or BAP values from duplicate injections differed by more than 15% relative difference.

The extracts were also analyzed in duplicate, gravimetrically (GRAV) for non-volatile organic material, using a method designed to quantify compounds boiling at 300° C. or higher. Weighing pans were prepared from methylene chloride-rinsed aluminum foil, baked overnight at 115° C., and cooled to constant mass±0.03 mg in a desiccator. A 1 ml sample was then added to each pan and volatile materials were allowed to evaporate in the open air and then in the desiccator until the pans reached a constant weight (within 0.03 mg or 1% of net extract weight, whichever was higher) in 2 successive measurements at least 4 hours apart. Data were rejected if duplicate samples differed by more than 20% from the average value. Typical precisions achieved (1.5% relative standard deviation) were much better than this standard.

The significance of differences between the mean values of various measured parameters for clay combustion runs and for clay/coal combustion runs was evaluated using a two-sided t test, assuming that each filter sample was independent of all others. The heat values of the burned coal were calculated based on the measured temperatures and relative humidities of the inlet and outlet air streams as well as the known flow rate of the inlet stream. The calculated heat value represented the sum of the energy required to produce the measured increase in air temperature and the energy required to evaporate enough water to account for the increase in relative humidity across the hut in excess of that which would be expected based on the stoichiometry of coal combustion.

The results for total particulate mass, TCO mass, BAP mass, and GRAV mass collected for the individual filter samples are summarized below in Table 1.

TABLE 1

| FILTER # | FUEL TYPE | ORGANIC MASS EMITTED/MASS COAL COMBUSTED PARTICULATE MASS/ COAL MASS (g/kg) | TCO/COAL MASS (mg/kg) | BAP/COAL MASS (mg/kg) | GRAV/COAL MASS (g/kg) |
|---|---|---|---|---|---|
| 1 | COAL | 28.8 | 35 | 49 | 26.444 |
| 7 | COAL | 32.3 | 24 | 43 | 29.055 |
| 8 | CLAY/COAL | 9.2 | 45 | 12 | 8.285 |
| 9 | CLAY/COAL | 20.4 | 11 | 25 | 18.918 |
| 10 | COAL | 11.0 | 38 | 38 | 10.690 |
| 11 | COAL | 53.8 | 818 | 64 | 46.347 |
| 12 | COAL | 40.0 | 308 | 34 | 38.115 |
| 13 | CLAY/COAL | 8.8 | 40 | 11 | 7.700 |
| 14 | CLAY/COAL | 6.1 | 7 | 11 | 5.472 |
| 15 | COAL | 56.7 | 735 | 53 | 50.176 |
| 17 | COAL | 31.2 | 257 | 26 | 28.461 |

NOTE:
Gaps in filter numbering are due to blanks and preliminary experiments.

As can be seen from reviewing the data in Table 1 above, the addition of clay binder material decreased total particulate emissions approximately 70%, TCO emissions approximately 90%, BAP emissions approximately 65%, and GRAV emissions approximately 70% when measured as mass emitted per mass coal combusted. It is noted that the data above is for experiments covering 5-6 hours sampling on a day of coal combustion or of clay/coal combustion, samples being taken every few days over about a 2 week span. These 5-6 hours, of course, do not represent the entire period of combustion for either material. Combustion and energy release would be expected to continue for many hours after the period studied.

Further, it is noted with respect to the data in Table 1 above that one of the coal samples (Filter No. 10) was collected under conditions where the burn rate (6.0 g/minute) was considerably lower than the average burn for the other coal-only samples (14.0±2.1 g/minute). If this sample is excluded from the analysis, slightly better control of organics and particulates is observed by all calculated measures. Values for all blank (hut, field, and laboratory) measurements of total particulate collected and GRAV were quite low (<4% of the values for average coal samples or clay/coal samples). The measured quantities in the TCO and BAP analyses were much closer to the detection limit of these analyses as performed, and some samples were below the detection limit. Thus, the blank values represent a much higher percentage of the average measured sample values (<4% of the coal average and <25% of the clay/coal average TCO and <50% of the average BAP values).

The levels of statistical significance for the decrease in particulate, TOO, BAP and GRAV emissions per mass coal combusted are $p=0.01$, $p=0.10$, $p=0.001$, and $p=0.01$, respectively. These decreases illustrate that the clay binders in coal do significantly decrease emissions.

GRAV (non-volatile) extractable organics represented 91.5±3.8% of the total coal combustion particulate collected and 90.0±1.9% of the total clay/coal combustion particulate collected. TCO (semi-volatile) extractable organics represented 0.707±0.563% of the total coal combustion particulate and 0.278±0.226% of the total clay/coal combustion particulate. This suggests that in these experiments the addition of the clay binder does not greatly increase the inorganic content of the particulate material. Indeed, since some of the remaining mass may be due to the inefficiency of soxhlet extraction or non-extractable organics, it is possible that very little inorganic material was present in either particulate.

The observed average particulate concentrations under controlled test conditions were 12.0±1.1 mg/m$^3$ for coal combustion with a hut air exchange rate of 2.87 exchanges/minute, 32.7±15.9 mg/m$^3$ for coal combustion with an air exchange rate of 0.99 exchanges/minute, and 11.7±3.9 mg/m$^3$ for clay/coal combustion with an air exchange rate of 0.99 exchanges/minute.

As can be seen from a review of Table 2 below, the addition of clay binder material appears to decrease the emission of total gas-phase hydrocarbons, measured on a mass-per-mass coal combusted basis. It is noted that the data below is for experiments covering 5-6 hours sampling on a day of coal combustion or of clay/coal combustion, samples being taken every few days over about a 2 week span.

TABLE 2

| FILTER # | FUEL TYPE | COMBUSTION GAS EMISSIONS PER COAL COMBUSTED CO PRODUCED/ COAL MASS (g/kg) | THC PRODUCED/ COAL MASS (g/kg) | $CO_2$ PRODUCED/ COAL MASS (g/kg) | $N_2O$ PRODUCED/ COAL MASS (g/kg) |
|---|---|---|---|---|---|
| 1 | COAL | | | 3,672 | 0.521 |
| 7 | COAL | | | 4,523 | 0.553 |
| 8 | CLAY/COAL | 121 | | 1,869 | 0.194 |
| 9 | CLAY/COAL | 262 | | 5,327 | 0.267 |
| 10 | COAL | 90 | | 391 | 0.031 |
| 11 | COAL | 165 | | 1,851 | 0.281 |
| 12 | COAL | 109 | | 2,026 | 0.213 |
| 13 | CLAY/COAL | 65 | 16 | 1,757 | 0.121 |
| 14 | CLAY/COAL | 97 | 15 | 3,187 | 0.113 |

TABLE 2-continued

| FILTER # | FUEL TYPE | COMBUSTION GAS EMISSIONS PER COAL COMBUSTED | | | |
|---|---|---|---|---|---|
| | | CO PRODUCED/ COAL MASS (g/kg) | THC PRODUCED/ COAL MASS (g/kg) | $CO_2$ PRODUCED/ COAL MASS (g/kg) | $N_2O$ PRODUCED/ COAL MASS (g/kg) |
| 15 | COAL | 136 | 80 | 1,868 | 0.205 |
| 17 | COAL | 152 | 46 | 3,194 | 0.255 |

NOTE:
Blank areas indicate invalid date. Gaps in filter numbering are due to blanks and preliminary experiments.

With regard to Table 2, it is difficult to assess the significance of these results since valid THC data were obtained in only one coal and one clay/coal test and observed concentrations exceeded the calibrated range of the instrument at some times; however, these results were reasonable in light of the observed decreases in organic emissions discussed above. Emissions of CO were unaffected by the addition of clay binder ($p=0.9$). Emissions of $CO_2$ may have been slightly increased, but this increase was not statistically significant ($p=0.7$).

It is noted that in Table 2 above, data for $O_2$ and NO are not presented since these measurements showed little change from baseline values (NO never exceeded 5 ppm and $O_2$ was never less than 20%). The average CO concentrations observed were 99 ppm in the coal tests and 124 ppm in the clay/coal tests. The average $CO_2$ concentrations observed were $0.134\pm0.050\%$ for the coal combustion experiments and $0.212\pm0.016\%$ for the clay/coal combustion experiments. $N_2O$ emissions appeared to be decreased (from $0.294\pm0.184$ to $0.173\pm0.072$ g/kg coal) by the addition of clay binder; however, this result was not statistically significant ($p=0.2$). The levels of $N_2O$ exiting the burn hut during coal combustion averaged approximately 0.1 ppm over ambient during both the coal and clay/coal combustion studies.

The calculated heat values per mass coal burned were $22.6\pm10.7$ MJ/kg for coal combustion and $26.9\pm15.4$ MJ/kg for clay/coal combustion. The difference between these values was not statistically significant ($p=0.8$), suggesting that clay does not have a major effect on heat value. The high variability of these values can be attributed to the lack of time resolution in the relative humidity data, the sensitivity of the analysis to small amounts of variability in the measured parameters, and the fact that the analysis did not account for the heat capacity of the hut and attached equipment.

In summary, the data presented in Tables 1 and 2 show that clay binders significantly controlled and decreased emissions from a coal combustion process in a natural draft setting. Measured as mass/mass coal combusted, emissions were controlled 70% for total particulate and GRAV, 65% for BAP, and 90% for TCO. However, the addition of clay binder appeared to have a lesser effect on the emissions of CO and $CO_2$, and a statistically insignificant effect on the emissions of $N_2O$.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method of decreasing air pollution resultant from burning a combustible carbonaceous material in a natural draft furnace, said method comprising decreasing emissions that cause air pollution by burning a combustible carbonaceous material, wherein the combustible carbonaceous material consists essentially of an admixture of a carbonaceous substance and a non-combustible binder material in the form of bricks, and wherein the bricks have been prepared by treating a carbonaceous substance with a non-combustible binder material, said treating being by mixing from about 70 to about 90 parts by volume of particles of the carbonaceous substance with about 30 to about 10 parts by volume of the non-combustible binder material, the binder material being clay, in a sufficient amount of water to obtain a moldable mixture, molding the aqueous mixture into a brick form, allowing the brick form to dry, and burning the bricks of carbonaceous substance treated with non-combustible clay binder material in a natural draft furnace at a temperature ranging from about 700° F. (about 371° C.) to about 1400° F. (about 760° C.), whereby the emissions are decreased from about 50 to about 90% as compared to the emissions from burning comparably sized carbonaceous substance free of any treatment with non-combustible clay binder material.

2. The method of claim 1, wherein the carbonaceous substance comprises coal.

3. The method of claim 2, wherein the carbonaceous substance is selected from the group consisting of coke, woody materials, lignite coal, anthracite coal, bituminous coal, and combinations thereof.

4. The method of claim 1, wherein the brick is of a suitable size to be used as is as a briquette.

5. The method of claim 4, wherein the briquettes are from about 2 to about 25 cm on a side.

6. The method of claim 1, wherein the bricks are large and are formed into a suitable size to be used as briquettes by breaking, cutting, pressing, or a combination thereof.

7. The method of claim 6, wherein the briquettes are from about 2 to about 25 cm on a side.

8. The method of claim 1, wherein the clay is selected from the group consisting of montmorillonite clay, bentonite clay, kaolinite clay, ball clay, and combinations thereof.

9. The method of claim 1, wherein the carbonaceous substance is present in an amount of about 70 to about 85 parts and the clay is present in an amount of about 15 to about 30 parts.

10. The method of claim 1, wherein the drying is at a temperature above about room temperature from about 2 to about 6 days.

11. The method of claim 10, wherein the drying is at a temperature above about 80° F. (about 27° C.) for about 3 to about 5 days.

12. The method of claim 1, wherein the natural draft furnace is selected from the group consisting of a residential furnace, a wood stove, or a light industrial furnace.

13. The method of claim 1, wherein the emissions are selected from the group consisting of particulate emissions, chromatographable organics, emissions, benzo(a)-pyrene emissions, gravimetric non-volatile organics emissions, and combinations thereof.

* * * * *